US005410779A

United States Patent [19]

Esman et al.

[11] Patent Number: 5,410,779

[45] Date of Patent: May 2, 1995

[54] HINGE

[76] Inventors: Igor I. Esman, ulitsa Respublikanskaya, 26, kv.151; Anatoly K. Gleb, ulitsa Ya. Mavra, 31, kv.108, both of Minsk, Belarus

[21] Appl. No.: 952,506

[22] PCT Filed: Mar. 27, 1991

[86] PCT No.: PCT/SU91/00049

§ 371 Date: Nov. 25, 1992

§ 102(e) Date: Nov. 25, 1992

[87] PCT Pub. No.: WO91/15646

PCT Pub. Date: Oct. 17, 1991

[30] Foreign Application Priority Data

Mar. 27, 1990 [SU] U.S.S.R. ..... 4806073

[51] Int. Cl.[6] ..... E05D 15/32

[52] U.S. Cl. ..... 16/370; 16/288; 160/229.1

[58] Field of Search ..... 16/288, 366, 368, 370, 16/227, 365; 160/135, 229.1

[56] References Cited

U.S. PATENT DOCUMENTS

| | | | |
|---|---|---|---|
| 328,342 | 10/1885 | Robinson | 160/135 |
| 683,222 | 9/1901 | Pearson | 16/366 |
| 1,235,789 | 8/1917 | Furgason | 16/370 |
| 1,387,962 | 8/1921 | Baerwaldt | 16/370 |
| 2,133,528 | 10/1938 | Bell . | |
| 2,135,280 | 11/1938 | Erickson . | |
| 2,178,271 | 10/1939 | Soss . | |
| 2,297,629 | 9/1942 | Meyer et al. . | |
| 2,694,216 | 11/1954 | Schnur . | |
| 3,881,221 | 5/1945 | Schmidt . | |
| 4,448,231 | 5/1984 | Salkeld et al. | 16/365 |
| 4,995,144 | 2/1991 | Gateley | 16/368 |
| 5,042,198 | 8/1991 | Privratsky . | |

FOREIGN PATENT DOCUMENTS

| | | | |
|---|---|---|---|
| 143751 | 6/1985 | European Pat. Off. . | |
| 261094 | 3/1988 | European Pat. Off. . | |
| 0261094 | 3/1988 | European Pat. Off. . | |
| 352912 | 1/1990 | European Pat. Off. . | |
| 2582342 | 11/1986 | France . | |
| 2461419 | 7/1976 | Germany . | |
| 7217 | of 1902 | United Kingdom | 160/135 |
| 5334 | of 1915 | United Kingdom | 16/370 |
| 2197022 | 5/1988 | United Kingdom . | |
| 462922 | 4/1975 | U.S.S.R. . | |

*Primary Examiner*—Lowell A. Larson
*Assistant Examiner*—Donald M. Gurley
*Attorney, Agent, or Firm*—Ladas & Parry

[57] ABSTRACT

The hinge (1), designed for suspension members (2 and 3), is provided with a flexible mechanism comprising a pair of joining components (4, 5), intended to be attached to corresponding suspension members (2 and 3) and connected to each other by means of the levers (6 and 7). The levers (6 and 7) are mounted with a freedom for reciprocal motions in parallel planes around rotation axles (8,9' and 8', 9) disposed on the joining components (4, 5). The levers (6, 7) have an equal length between their rotation axles (8,9' and 8',9) whereas the locus of points, formed at a turn of the joining components (4 and 5) relative to each other by the intersection of the longitudinal axes (F1 F2 and F3 F4) of the levers (6 and 7) on a plane parallel to the plane of the lever movements, is an elliptical curve.

14 Claims, 11 Drawing Sheets

HINGE

FIELD OF THE INVENTION

The invention relates to the appliances for hinged joints of suspension members and, more specifically, to the hinges, used to connect such structural components as door wings and window panes, parts of sliding partitions and various moving and transformable structures, including those used in construction, stage sceneries, arrangement of easy compartment replanning, technical and household articles and the like.

PRIOR ART

Known in the art is a hinge comprising stationary and moving parts, connected by means of flexible joints. A joining component represents a spring-loaded rod free to move in the axial direction, joined with tile moving part by means of a flexible joint (the USSR Author's Certificate No. 462922). This hinge does not project beyond the suspension members, but it ensures turning only through 180°. Such a hinge is complicated to produce and has a limited strength.

Known are flexible joints for connecting two suspension members, described, for instance, in the U.S. Pat. Nos. 2,135,280, 2,178,271, 2,694,216. The design of said appliances involves the use of hinge-and-lever mechanisms for connecting with each other joining components, attached to the suspension members. Herein in all the known appliances of the type there is only one axis of symmetry, located between two parts of the mechanism and running through the central axle of rotation, connecting two levers which are provided with additional levers of another length (the U.S. Pat. Nos. 2,133,528, 2,694,216) or additional sliding axles (the U.S. Pat. No. 2,178,271), connecting levers with joining components. Upon turning of the suspension members through any angle, the levers protrude beyond the limits of the suspension members.

In the known hinges, the joining components are linked with each other by four levers, mounted for movement in the plane of rotation of the joining components and connected by means of five axles of rotation normal to the indicated plane of rotation. In this case a complicated hinge-and-lever system is derived which requires production of connecting levers of at least two sizes. The reliability of such a system is also not high. This is a result of a great number of hinge joints in the system (five axles connecting levers with each other and with joining components). Thereto, since levers project beyond the suspension members upon turning, they are subject to bending strain under the effect of the weight of the suspension members, which is extremely undesirable as it requires an increase in the rigidity of the levers either by increasing the cross-section area or by using more rigorous materials for production.

The main drawback of the hinges described above is the possibility of only a limited reciprocal turn of the suspension members and only to one side through 180° (the U.S. Pat. Nos. 2,178,271, 2,694,216)or through 90° (the U.S. Pat. No. 2,135,280).

The fact that levers extend beyond the suspension members during their turning reduces the aesthetic appearance of the hinge and makes it unsafe, especially when it is necessary to mount extra levers in the middle portion of the suspension members for heavy door wings, for instance. Since, as a result of carelessness, people may be injured by protruding parts of the levers.

DISCLOSURE OF THE INVENTION

The invention is based on the object of making a hinge-and-lever mechanism of a hinge for connecting suspension members so as to ensure a turning of one of the suspension members to both sides or a reciprocal turning of suspension members through 180° as well as a turn of one of the suspension members relative to the other through 360° with a minimum number of structural elements of the hinge and their connections and with no projection of the levers beyond the suspension members upon turning the latter, therethrough offering a possibility of self-return of the suspension members to the initial position after the aforeindicated turning of the connected suspension members.

Said object is realized in the applied hinge for suspension members comprizing a flexible joint, including a pair of joining components, designed to be attached to appropriate suspension members and connected with each other by means of levers, mounted with a freedom for reciprocal motion in parallel planes around the axle of rotation, fixed on the joining components, in accordance with the invention, the levers having an equal length between trait axles of rotation and the locus of points, formed in the course of turning of the joining components relative to each other by the intersection of the longitudinal axes of the levers on a plane parallel to the plane of lever movement, being an elliptical curve.

With such a design of the hinge, owing to the employment of two levers of an equal length, ensured is a turn of each joining component to both sides or a reciprocal turn of the joining components through 180° as well as a turn of one the suspension members relative to the other through 360° with no projection of the levers beyond the limits of the joining components. Thereto it is evident that the applied hinge has only two levers and four axles of rotation for their connection with the joining components, all the axles of rotation being mounted within the joining components, whereas the levers are also within the limits of the joining components. This promotes an improvement of reliability and an increase in strength of the applied hinge due to elimination of a bending strain. The fact that the levers do not protrude beyond the limits of the joining components in the course of their turning, ensures an improvement of aesthentic appearance and the safety of said hinge.

The intersection points of the lever rotation geometric axes with a plane parallel to the plane of lever movement can be located at the vertexes of a quadrangle with the joining components disposed coaxially, or these intersection points can be located at the vertexes of the quadrangle with the joining components being parallel.

There is a good reason to have a distance between intersection points of the geometrical axes of the lever rotation axles with a plane that is parallel to that of lever movement not less than the greatest size of a joining component in a plane which passes through the geometrical axes with the axles of rotation being located in this plane.

Thereto a freedom for reciprocal movements of joining components is ensured.

There is a good reason to halve convex curved end surfaces of the joining components, facing each other, with their generating lines being parallel to the geometrical axes of the rotation axles.

Such a design provides for minimizing clearances between the joining components in a position they keeps being in one and same plane (with the door wings closed, for instance).

The intersection of a convex curved surface by a plane parallel to that of lever movement is preferentially a semi-ellipse being a locus of points, formed by the intersection of the above indicated lever longitudinal axes on a plane parallel to that of lever movement.

Such a design practically ensures a complete absence of a clearance between the suspension members in any position owing to the feasibly ideal mutual geometrical running-in of the joining component conjugated surfaces.

In the variant of the hinge design in accordance with the invention, each joining component has two slots to house levers. and each of the slots are provided with rest surfaces in opposition to each other and a pair of spring-loaded rods with a freedom to move, the free ends of which interact with the rest surfaces of the levers.

The hinge of such a design is provided with forced self-return of one or the both joining components to the initial position as well as with a definite force to hold the suspension members in the closed position. This considerably improves operating features of the applied hinge and extends the range of its application.

The rods are preferentially provided with flanges and the joining components with rests, between the rest of the joining components and the flanges of the rods there are mounted springs.

Each joining component is preferentially provided with a locking mechanism for spring-loaded rods against motion.

In such a design the suspension members are provided with selective stopping against a spontaneous turn as well as with adjustment of the effort, required for their turn.

The spring-loaded rods are preferentially provided with pushers, flexibly attached to the vacant ends of the rods for interaction with the lever rest surfaces.

Such a design increases reliability and makes the production and assembly of the applied hinge simpler.

BRIEF DESCRIPTION OF THE DRAWINGS

Herein after various variants of the invention embodiment are described in details with references to the following appended drawings.

DETAILED DESCRIPTION OF THE PREFERRED EMBODIMENTS

The preferable variant of the invention embodiment.

Figure 1:
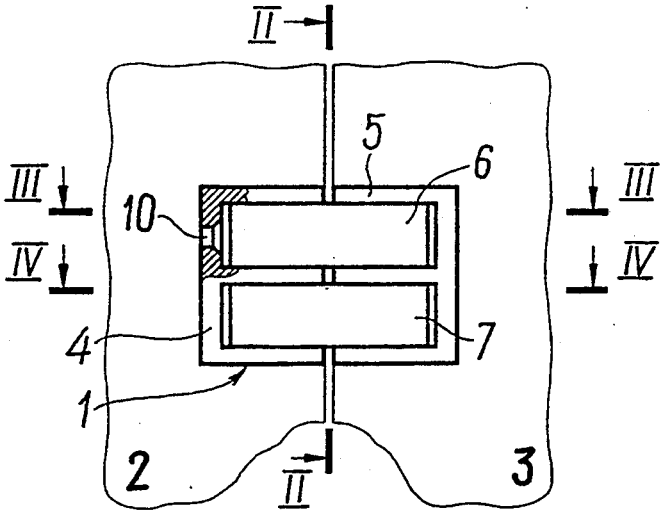
FIG. 1 presents a general view of the hinge, persuant to the present invention (front view)
Figure 2:
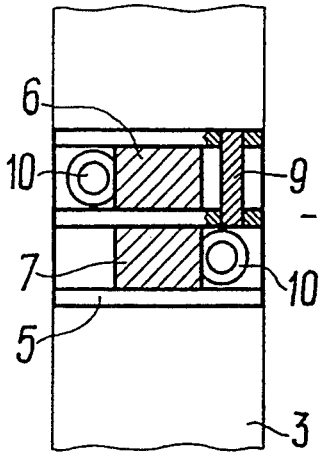
FIG. 2 is a sectional view on the line II—II in FIG. 1.
Figure 3:
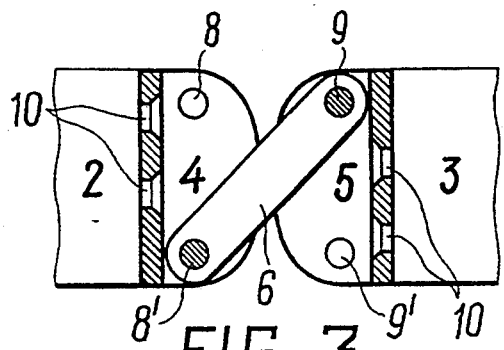
FIG. 3 is a sectional view on the line III—III in FIG. 1.
Figure 4:
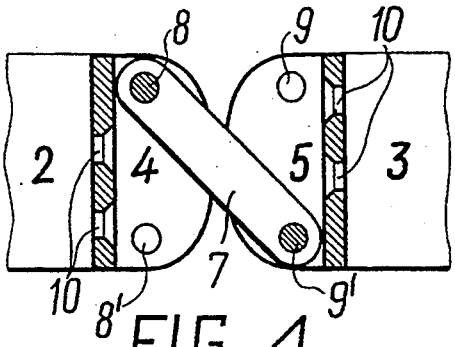
FIG. 4 is a sectional view on the line IV—IV in FIG. 1.
Figure 5:
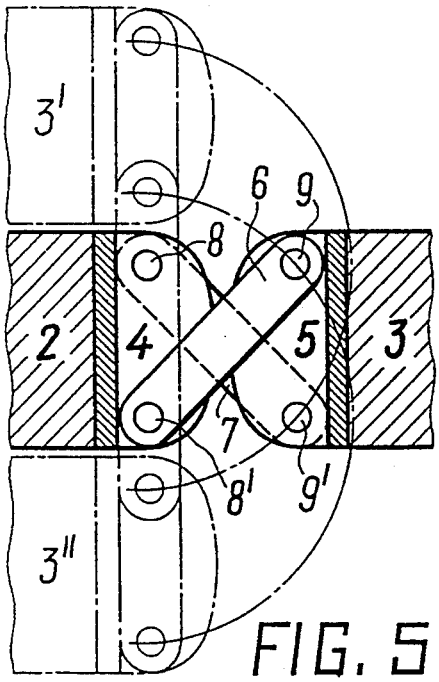
FIG. 5 is a view similar to FIG. 1 (shown is the position of one of the suspension members, connected by the hinge persuant to the invention, "closed", "open to one side through 180°" and "open to the other side through 180°")

The applied hinge 1 (FIG. 1) is designed mainly for connecting suspension members 2 and 3 comprising a pair of joining components 4,5 intended to be joined with the suspension members 2 and 3, respectively, for turning relative to each other in a plane normal to the plane in FIG. 1. To this end, the hinge is provided with s pair of levers 6, 7 (FIGS. 1 to 5), mounted with a freedom for reciprocal movements in parallel planes around the rotation axles 8,9' and 8',9, fixed respectively on the joining components 4 and 5. The planes, in which the levers 6 and 7 move, are parallel to that of the turning of the suspension members 2 and 3. The lengths of the levers 6 and 7 between their rotation axles(or, what is the same, the distances between the geometric centers of the rotation axles 8,9' and 8',9 in the projection the plane of turning(the drawing plane)) are equal. FIG. 5 illustrates two positions of the suspension members 3, 3' and 3''.

Figure 6:
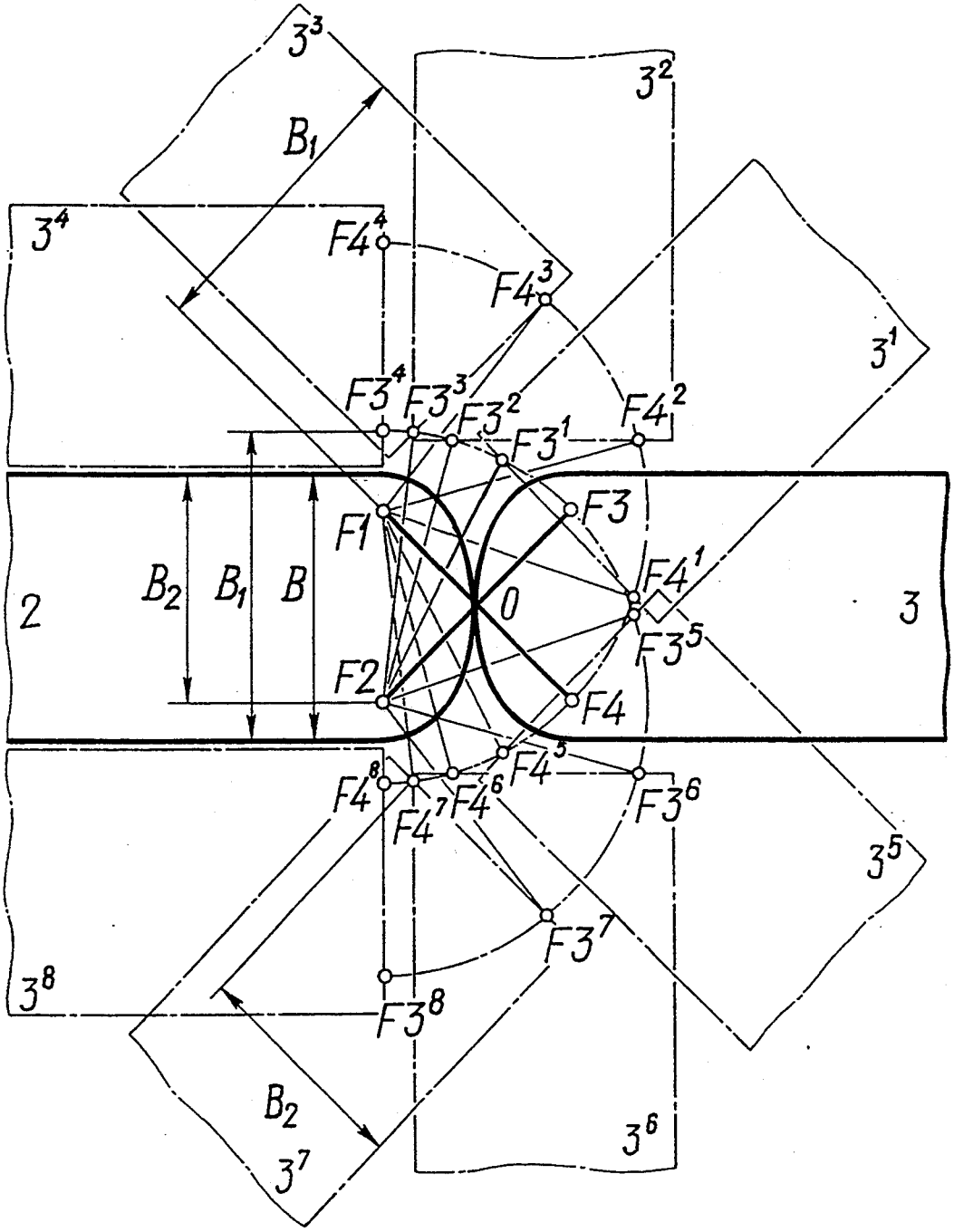
FIG. 6 is a schematic showing of the locus-of-intersection points construction of the lever longitudinal axes at a reciprocal turn of the suspension members, connected by the hinge, persuant to the invention, for the top view.

The longitudinal axes F1 F2 and F3 F4 of the levers 6 and 7 (FIG. 6) with the suspension members moved relative to each other, for instance, from the position indicated by solid lines, to the position, shown by dotted lines, by intersecting each other in the projection in the plane of turning (the drawing plane), form a locus of points that constitutes an elliptical curve. This is self-evident from the geometrical construction, shown in FIG. 6, where the successive positions of the suspension member 3 are defined by the positions $3^1$–$3^8$. Such a specific feature of the applied hinge ensures a reciprocal turning of the suspension members through an angle of 180° without any projection of the levers 6 and. 7 beyond the limits of the suspension members. FIG. 6 is a schematic showing of the applied hinge without joining components in the form of longitudinal axes F1 F2 and F3 F4 of the levers, connecting the suspension members 2 and 3 by means of rotation axles 8,8' and 9,9' the geometrical axes of which are defined respectively by points F1, F2 and F3, F4.

In FIG. 6, the locus of the points of intersection of the longitudinal axes of levers 6, 7, upon relative rotation of suspension members 2, 3, lies along the elliptical curve forming the end surface of joining component 4. In this way, the axes at F1 and F2 are at the focal points of the elliptical curve.

Figure 7:
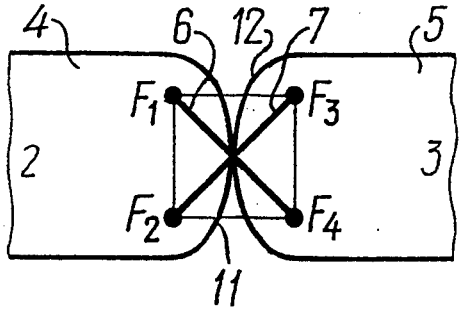
FIGS. 7 to 12 are schematic showings of the relative locations of the hinge lever rotation axles, persuant to the invention.
Figure 8:
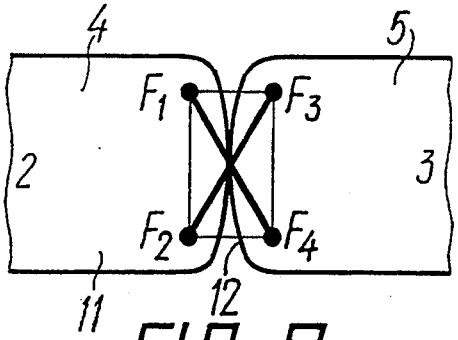
Figure 10:
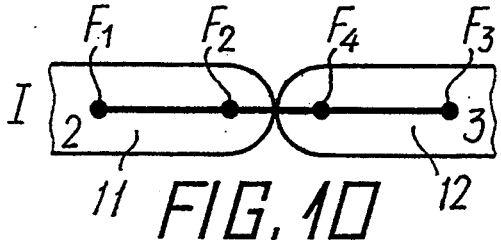
Figure 11:
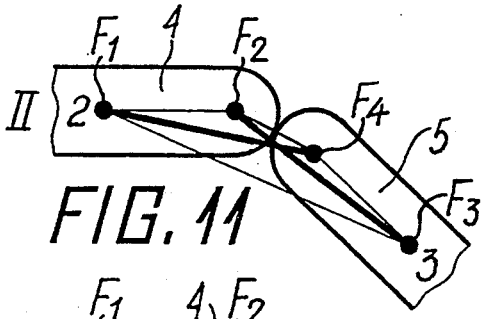
Figure 12:
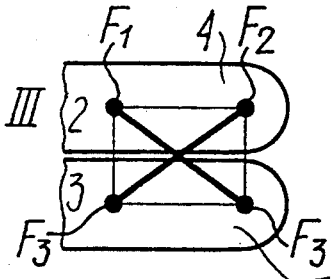
Figure 9:
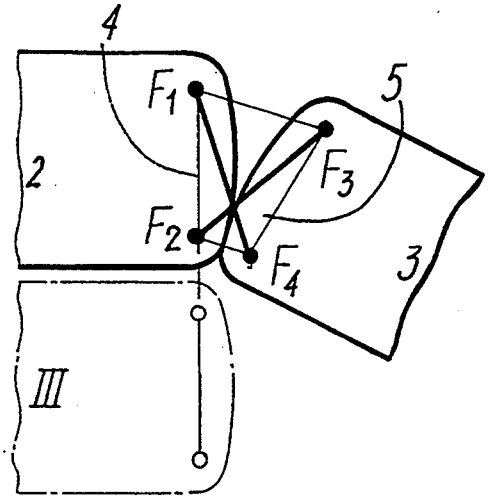

As indicated by thin lines in FIG. 7, the points F1, F2 and F3, F4 obtained due to intersection of the geometrical axes of rotation of the levers 6 and 7 by a plane parallel to that of the lever movement, are located at the vertexes of a quadrangle with the longitudinal axes F1 F4 and F2 F3 of the levers, passing through points F1, F2 and F3, F4, originated at intersection of the geometrical axes of the rotation axles 8,9' and 8',9 of the levers 6 and 7 by a plane parallel to that of the lever movement, are on the diagonals of the quadrangle. Although FIG. 3 indicates that the points F1, F2 and F3, F4 of intersection of the geometrical axes of the levers 6 and 7 rotation axles 8,9' and 8',9 by a plane parallel to that of the lever movement, are located on the diagonals of the quadrangle with the joining components being disposed coaxially, it is evident that possible are various relative positions of the rotation axles with the suspension members being disposed coaxially and parallel, as it is schematically shown in FIGS. 7 to 12, which depict only the longitudinal axes F1 F4 and F2 F3 of the levers 6 and 7 without joining components 4,5.

As is indicated in FIGS. 1 to 5, the levers 6, 7 are disposed at different sides relative to the surfaces of joining components 4 , 5, which is most advisable from the point of view of load distribution. But this is not obligatory, and the levers can be mounted, if required, at one and the same side of the above indicated surfaces. To do this, it is possible to use various technical methods to ensure lever movement in parallel planes, which are well known to specialists and have nothing to do with the idea of the present invention.

The distance F1–F4 of F2–F3 between the intersection points F1, F2 and F3, F4 of the geometrical axes of the rotation axles 8,9' and 8',9 of the levers 6, 7 with a plane parallel to that of the lever movement is at least equal to the greatest size "B" of the joining component 4 or 5 in a plane, passing through the geometrical axes of the rotation axles, respectively, 8,9' and 8',9, located in this component (FIG. 6) FIG. 6 shows herein that with the size of the joining component being $B_1 > B$, the joining component 4 (not shown in FIG. 6) along with the suspension member 2 will not be able to take the position $3^4$, indicated by the dotted line in the upper part of FIG. 6. It is quite permissible to have a reverse position with a distance F1–F4 or F2–F3 between intersection points F1, F2 and F3, F4 of the geometrical axes of the levers 6, 7 rotation axles by a plane parallel to that of lever movement, being greater than the greatest size $B_2$ of the joining component 4 or 5 in the plane, passing through the geometrical axes of the rotation axles, respectively, 8,9' and 8',9 located in this component. Such a variant can be used, when it is required to have a gap between the suspension members after their turn to the parallel position. In this case small parts of the levers 6 and 7 will project only insignificantly beyond the limits of the joining components 4, 5 or suspension members 2, 3, as is shown in the lower part of FIG. 6 in the position $3^8$ of the suspension member.

The joining components 4, 5 are attached to the suspension members 2, 3, they connect to each other by any known means, for instance, by screws, glue, welding and the like, but preferentially in combination with cutting-in to obtain the best decorative effect. With this aim, as FIGS. 1 to 4 show, the joining components 4, 5 are provided with holes 10 for screws.

To employ the applied hinge, the joining components 4 and 5, connected to each other by the levers 6 and 7, are attached, as indicated above, to the suspension members 2 and 3, respectively. It is possible not to connect the joining components 4 and 5 to each other by the levers 6 and 7 before they are attached to the suspension members 2 and 3. The levers can be mounted after the joining components 4 and 5 are attached to the suspension members 2 and 3, respectively.

If required, one of the suspension members 2 (a door wing, for instance) is turned from the position 2 to the position $2^8$, as shown in FIG. 6, until it is fully open through 180°. In this case a reciprocal motion of the levers 6 and 7 takes place, as illustrated by a change in the relative positions of their longitudinal axes F1 F4 and F2 F3 from F1 F4 and F2 F3 to $F1^8$ $F4^8$ and $F2^8$ $F3^8$ (FIG. 6).

As illustrated in FIGS. 7 to 12, the facing end surfaces of the joining components (not shown) are convex curved surfaces 11–13, whose generating lines are parallel to the geometrical axes of the rotation axles 8,9' and 8',9 of the levers 6, 7. This being the case, it is advisable to have the section of the convex curved surfaces 11–13 by a plane, parallel to the plane of the levers 6, 7 movement, as a semi-ellipse, being a locus of points, formed at a joining component turn relative to each other by the intersection of the longitudinal axes F1 F4 and F2 F3 of the levers 6, 7 by a plane, parallel to that of the lever movement, as shown in FIG. 6. In this figure the semi-ellipse with focusses F1 and F2, formed as aforeindicated, is a cross-section of the convex curved end surface of the joining component 4 (not shown) and the end surface of the suspension member 2. In this case the clearance between end surfaces of the suspension members 2, 3 is at minimum and in the ideal case is equal to zero.

Figure 13:
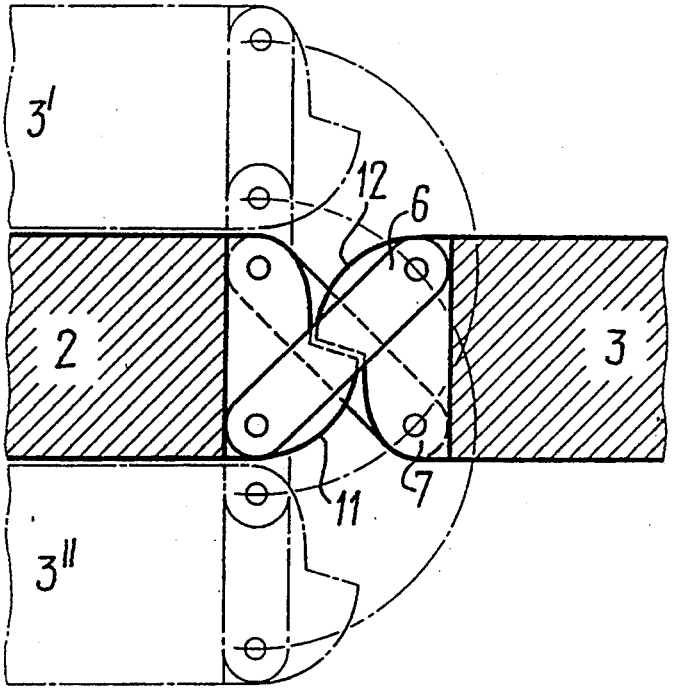
FIG. 13 is a schematic showing of the hinge, persuant the invention, for the top view in the variant with the end surfaces of the hinge joining components being parts of elliptical surfaces.
Figure 14:
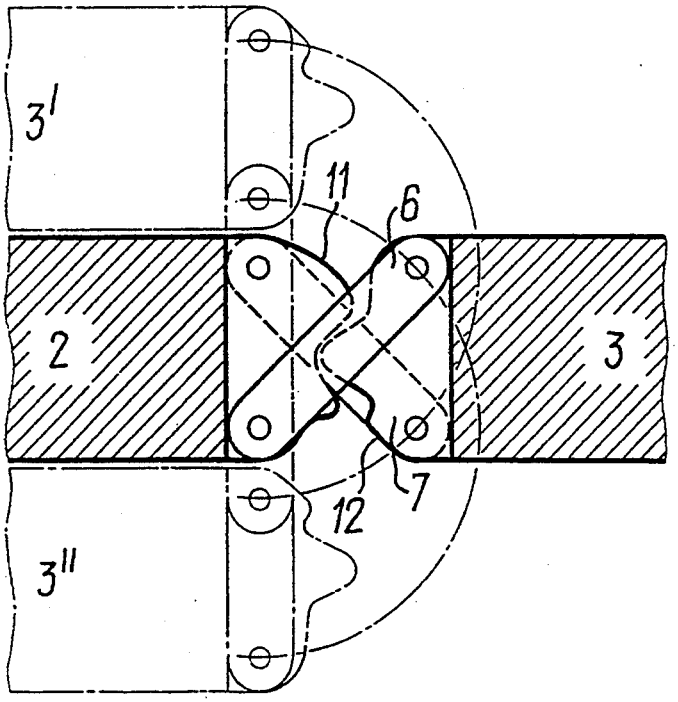
FIG. 14 is a schematic showing of the hinge, persuant to the invention, for the top view in the variant with the end surfaces of the hinge joining components, having concave portions.
Figure 16:
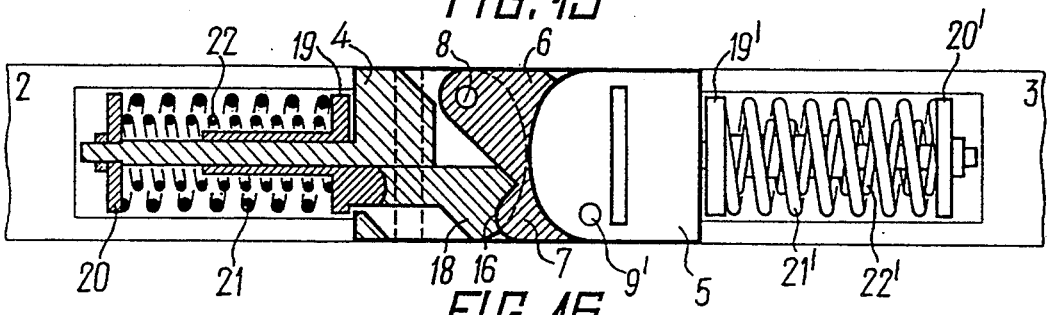
FIG. 16 is a sectional view on the line XVI—XVI (left part of the drawing) and a view along arrow"A"(-right part of the drawing) in FIG. 15.
Figure 21:
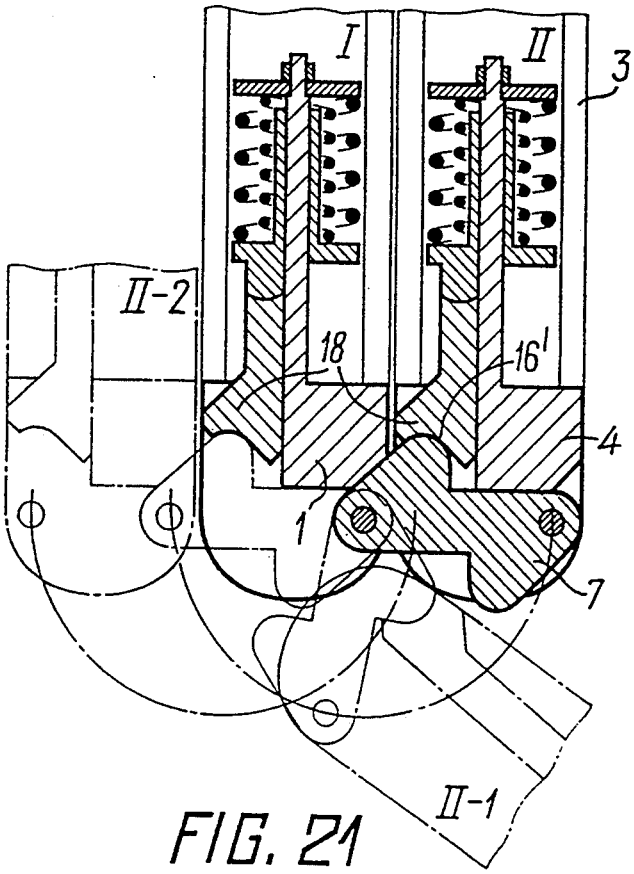
FIG. 21 is a view of the hinge, persuant to the invention, for the top view showing intermediate phases of the hinge joining component turn from the position II-1 of the hinge joining components to the position II-2 "open to the other side"

It should be evident to specialists that various modifications are possible concerning the making of the joining component (suspension member) end surfaces, which can be parts of elliptical surfaces (FIG. 13) or have concave portions (FIG. 16). Such surfaces can be used to obtain more reliable tightening or to achieve other objects, depending on the purpose of the hinge. The employment of these variants in the hinge design is evident from FIGS. 13, 14.

in the design variant, presented in FIGS. 15 to 21, in which the described above elements are defined by the same Ref. Nos, each joining component 4, 5 has two slots 14, 15 or 14', 15' (FIG. 15), intended to accomodate the levers 6, 7 and provided with rest surfaces 16, 17 and 16', 17' in opposition to each other and with a pair of the spring-loaded rods 18 having a freedom to move, the free ends of which are intended to interact act with the rest surfaces 16, 17 and 16', 17' of the levers 6, 7. The rods 18 are mounted with a freedom for axial motion and provided with flanges 19, while the joining components 4, 5 have rests 20, 20'. Between the rests 20 and 20' of the joining components 4, 5 and the flanges 19 of the rods 18 there are mounted springs 21, 21', inside of which there are additional springs 22, 22' (not obligatory). In this construction under standard conditions the rods 18 are pressed to the rest surfaces 16, 17 and 16', 17' of the levers 6, 7 by the springs 21, 21' and the additional springs 22, 22' to hold the suspension members 2 and in a coaxial (closed) position and to ensure their self-return to this position after their turn to the parallel position (FIG. 21).

The joining component 4, 5 has a separation web 23, 23', disposed between the slots 14, 15 and 14', 15' to accomodate the levers 6 and 7 and provided with a hole 24, 24' (FIG. 20) with an axis 0—0' located in the symmetry plane of the slots 14, 15 and 14', 15'.

The body of the joining component 4, 5 is furnished with guiding holes 25, 26 and 25', 26' (FIGS. 18 to 20), intersecting the hole 24, 24' in the separation web 23, 23' of the joining component 4, 5 and disposed in the direction of the spring-loaded rod 18 movement. The ends of the rods 18 having flats 27 (FIGS. 18 to 20) are arranged in the guiding holes 25, 26 and 25', 26'.

Figure 19:
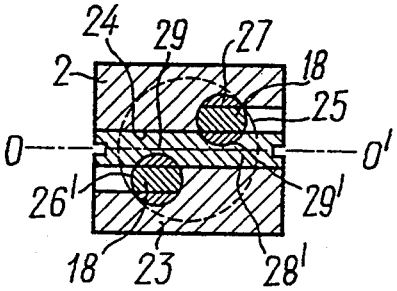
FIG. 19 is a sectional view on the line XIX—XIX in FIG. 15.

The hinge is provided with a spring-loaded rod 18 locking mechanism against motion, made in the form of a stopping element 28, 28', the separation web 23, 23' of the joining component 4, 5. The stopping element 28, 28' has a shape of a cylindrical stem, furnished with diametrically opposite grooves 29, 29', spaced along the side surface of the stem (FIG. 19). The rods 18 (FIGS. 18 to 20) enter the grooves 29, 29' of the stopping element 28, 28' with the width of the flats 27 being smaller than that of the grooves 29, 29'.

A variant of the design, presented in FIGS. 23 to 29, in which the described above elements are designated by the same Ref. Nos, is similar to the previous one, except for the only difference; the spring-loaded rods 18 are furnished with pushers **18*a*, flexibly attached by means of pins 30 to the vacant ends of the rods to interact with the rest surfaces 16, 17 and 16', 17' of the levers 6, 7. The pushers 18*a* have a shape of plates while the cross-section of the rods is cylindrical. The rods 18 are fitted with tail pieces 18*b* of a smaller diameter with tile formation of rest surfaces. The tail pieces 18*b* enter blind holes 31 of the flange of a movable rest 33, fixed on the guiding element 34, rigidly connected to the joining component, 4 and having a stationary rest 35. The stopping element 28 is made up in the shape of a cylindrical stem that is furnished with diametrically opposite grooves 29 of a semi-circular cross-section along the whole length of the stopping element, which receive the rods 18. The width of the pusher plates is smaller than that of the grooves 29 of the stopping element 28. The stopping element 28 is furnished with a slit 36** to turn the former.

In the variant of the applied hinge design, presented in FIGS. 30 to 36, in which the described above elements are designated by the same Ref. Nos, each joining component 4, 5 is made with a guiding slot 37, 37' in a plane parallel to that of movement of the levers 6 and 7, while the slots 14, 15 and 14', 15', accomodating the levers, are formed by the separation web 38, 38' disposed parallel to the levers 6 and 7 and arranged in a part of the guiding slot 37, 37' from the side of the end surface 39, 39' (FIG. 32) of the joining component 4, 5 and connected with the guiding slot 37, 37' by means of a through slot 40, 40' (FIG. 36), disposed parallel to the plane of the separation web 38, 38'. The levers 6 , 7 are mounted in the guiding slot 37, 37' on both sides of the separation web 38, 38' (FIGS. 30 to 33). In the cross-section by a plane normal to those of the lever 6, 7 movements, the guiding slot 37, 37' has two skew-symmetric recesses 41, 42, 41', 42'. In this variant the pushers are made as a pair of double-arm levers 43, 44, 43', 44', flexibly attached to each joining component 4,5, with one set of arms 45,46,45',46', flexibly attached to the spring-loaded rods 18 mounted in the guiding holes (not designated) of the joining component normal to the separation web 38, 38', while the other set of the lever arms 47, 48, 47', 48' bear against the end plane of the pressing element 49, 49', arranged in the guiding hole 37, 37' and having a cross-section, corresponding to the guiding slot 37, 37' from the side opposite to the side of the end plane of the pressing element 49, 49' end.

The spring-loaded rod 18 locking mechanism against motion is made up in a form of a closing accentric cam 51, 51', mounted on the rotation axle 52, 52' in the through slot 40, 40' and ring a projecting control boss 53, 53' (FIGS. 31 to 33 and 36). The end of the pressing element 49, 49' opposite to the forenoted end plane features a recess 50, 50', which makes a step in the cross-section by a plane parallel to the plane of the separation web 38, 38' (FIGS. 31 to 33 and 35).

The description of the design variant operations, illustrated in FIGS. 15 to 21.

Figure 15:
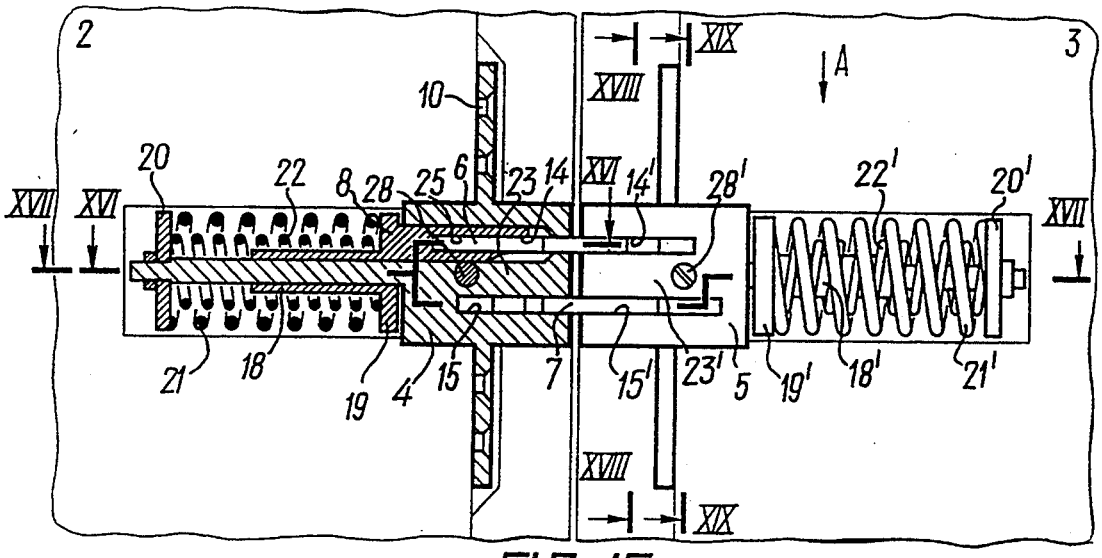
FIG. 15 illustrates a variant of the hinge design, persuant to the invention, for the front view with a partial cross-section of the suspension member self-return mechanism to the initial position.
Figure 17:
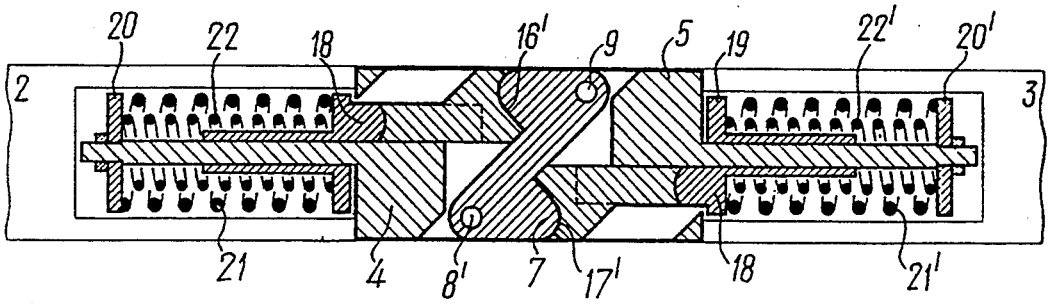
FIG. 17 is a sectional view on the line XVII—XVII in FIG. 15.
Figure 18:
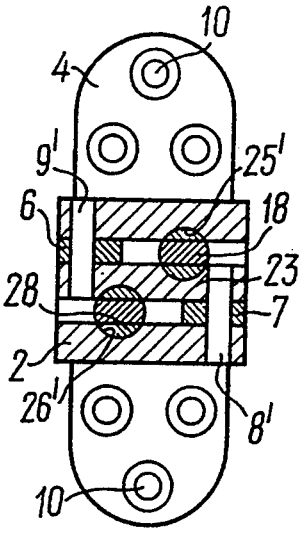
FIG. 18 is a sectional view on the line XVIII—XVIII in FIG. 15.
Figure 20:
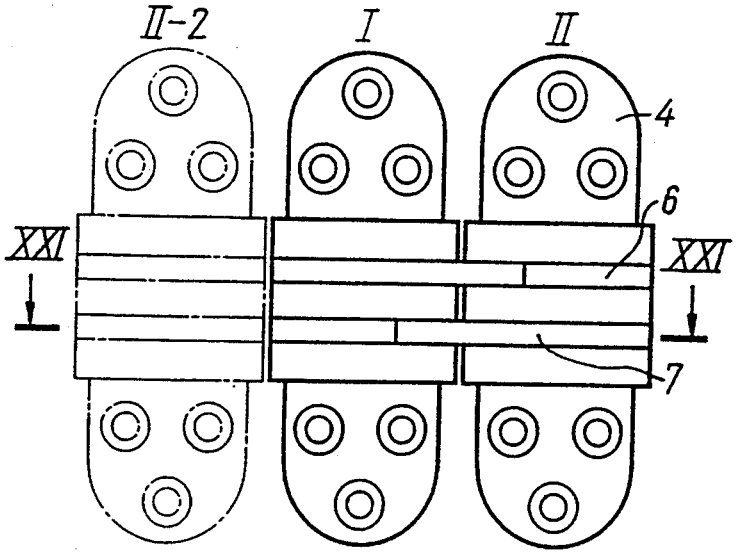
FIG. 20 is a view of the hinge, persuant to the invention, for the front view, which shows the hinge joining components in the open positions II and II-2.

In the initial position on the suspension members 2, 3 (FIGS. 15, 16) are disposed coaxially so that their end surfaces, which face each other, are joined. This position corresponds, for instance, to the position of closed doors. In the said position the rods 18 (FIGS. 18, 19) enter the grooves 29, 29' of the stopping elements 28,

28', and since the width of the flats 27 is smaller than the width of the grooves 29,29', the rods can easily move. a turn of one of the suspension members 3 relative to the other suspension member 2 (FIG. 21 ) the springs 21, 22 and 21', 22' get compressed by the pressure exerted by the flanges 19 of the rods 18, that move under the action of the rest surfaces 16, 17 and 16', 17' which turn the levers 6, 7 (FIGS. 15 to 17 and 21). Thereupon the suspension members take positions parallel to each other. In case a held suspension member, for instance, the suspension member 3 is released, the springs 21, 22 and 21', 22' get loose, exerting pressure on the rods 18 by means of the flanges 19. The ends of the rods 18 act upon the rest surfaces 16, 17 and 16',17' of the levers 6, 7 (FIGS. 15 to 17 and 21). Whereupon the levers 6, 7 turn in the opposite direction, which causes a turn of the suspension members 2 and 3 relative to each other and the suspension members return to the initial position (FIGS. 15 to 17). Such an operation of the applied hinge can be used, for instance, when self-closing doors or panes of various mechanisms are employed.

Figure 22:
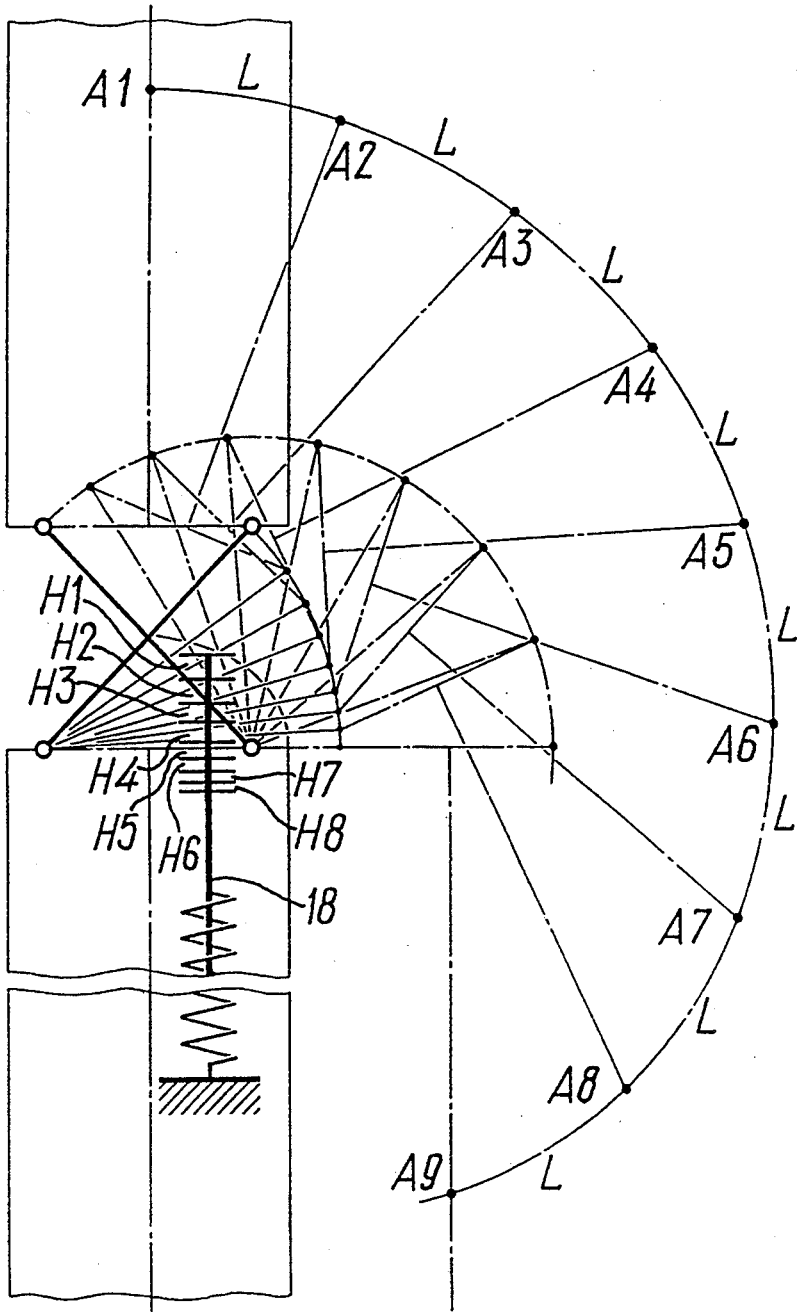
FIG. 22 is a diagrammatical showing of the hinge spring-loaded rod movements, persuant to the invention, for the top view depending on the motions of a hinge joining component.
Figure 23:
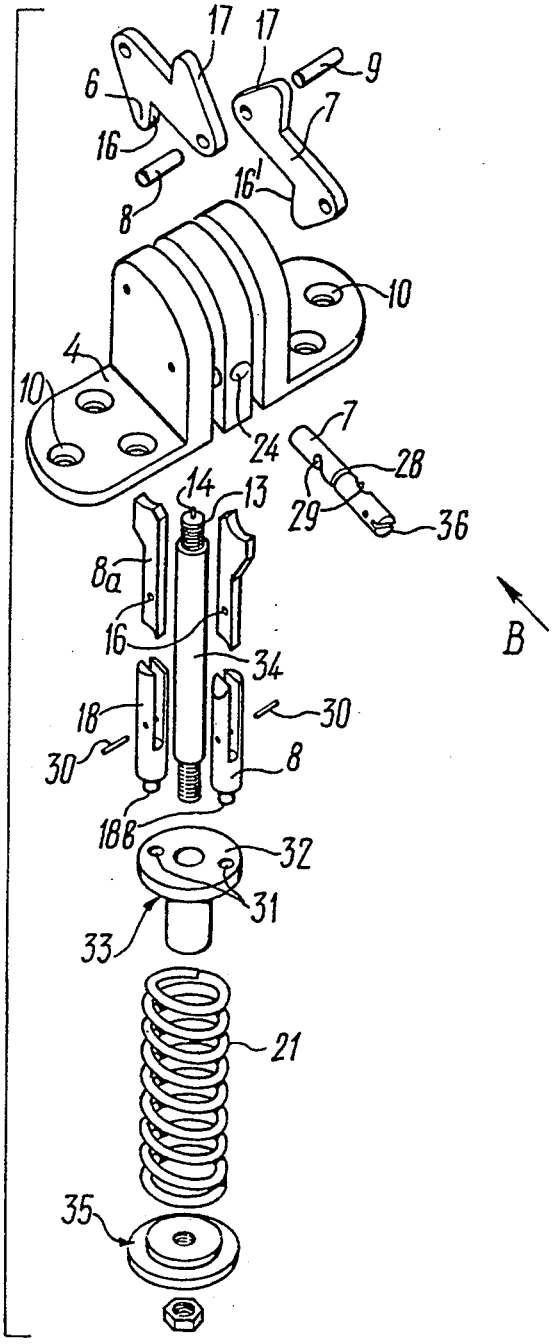
FIG. 23 is a schematic showing of the hinge design variant in the exploded view, persuant to the invention, for the front view with a partial cross-section of the joining component self-return mechanism to the initial position.
Figure 24:
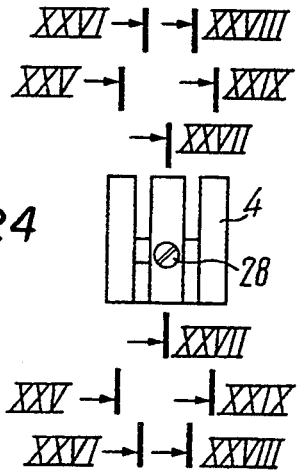
FIG. 24 is a view along arrow "B" in FIG. 23.

FIG. 22 presents a diagram of the spring-loaded rod 18 movements versus the movements of a suspension member, where single movements of a suspension member, designated by letter "L", are indicated equally and in conformity with the movements of the rod 18, designated by letter "H", from H1 to H8. The diagram makes it evident that the spring-loaded rod movement values decrease with a turn of the suspension member towards opening. Owing to this, the effort exerted to the suspension member to open open it drops quicker than the resistance of the springs which rises during the compression of the springs. Therewith, owing to an instant drop to zero of a force in the suspension member mechanism of self-return to the initial position as soon as the rods 18 get stopped by the joining components 4, 5 in the close (coaxial) position of the suspension members, which do not swing in this position.

In case it is required to abandon the use of the suspension members 2 and 3 mechanism of self-return to the initial position, a quater turn of the stopping element 28 is effected by means of the slit 36 with the suspension members 2 and 3 being parallel to each other (in the door open position, for instance) and the springs 21, 22 and 21', 22' compressed (FIG. 21). Thereupon, parts of the rods, located behind the flats 27, bear against the side surfaces of the stopping elements 28, 28' and exert no pressure to the levers 6 and 7. In tile course of a forced turn of the suspension members 2 and 3, the rods 18 remain motionless and have no influence of the hinge operation. In this case the hinge operation is similar in everything to the design variants heretofore described.

In case it is required to reduce the effort needed to open the suspension members 2 and 3, it is possible to turn the stopping element 28 only of one of the suspension members, which results in disengagement of the pair of spring-loaded rods 18. The other pair of the rods continue to act on both the levers 6 , 7 In the case of the springs failure, the applied hinge continues to operate under the conditions of a reduced effort, required for opening and self-return of the suspension members 2 and 3. In case all the springs are broken, the hinge proceeds operating but with no self-return of the suspension members to the initial position.

Since the rods 18 bear freely against the rest surfaces of the levers 6 and 7, the moment of weight is fully absorbed by the levers 6 and 7 and it does not act on the springs. This improves the reliability of the hinge.

A variant of the applied hinge design, presented in FIGS. 23 to 29, operates in a similar way with an only exception: the rods 18 interact with the rest surfaces 16, 17 and 16', 17' of the levers 6 and 7 by means of the pushers 18*a*, flexibly attached to the vacant ends of the rods 18 by pins 30. Such a design improves reliability and makes the assembly procedures simpler.

The description of the design variant operation, illustrated in FIGS. 30 to 36.

Figure 31:
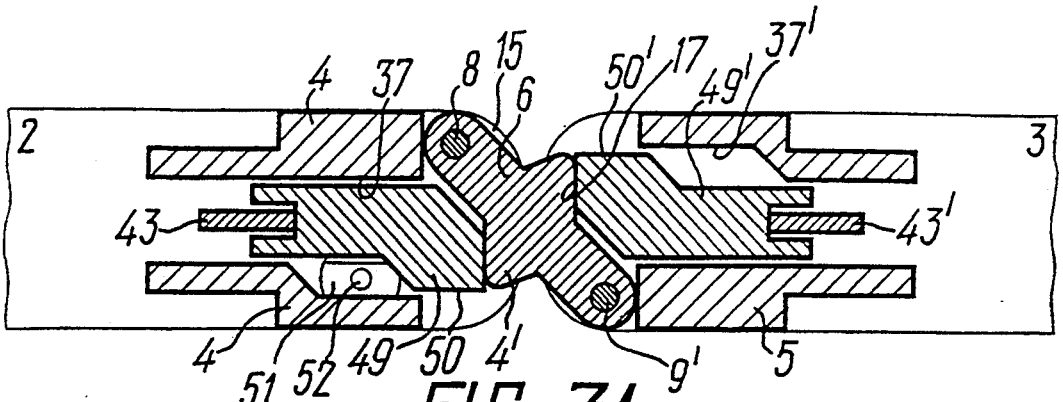
FIG. 31 is a sectional view on the line XXXI—XXXI in FIG. 30.
Figure 32:
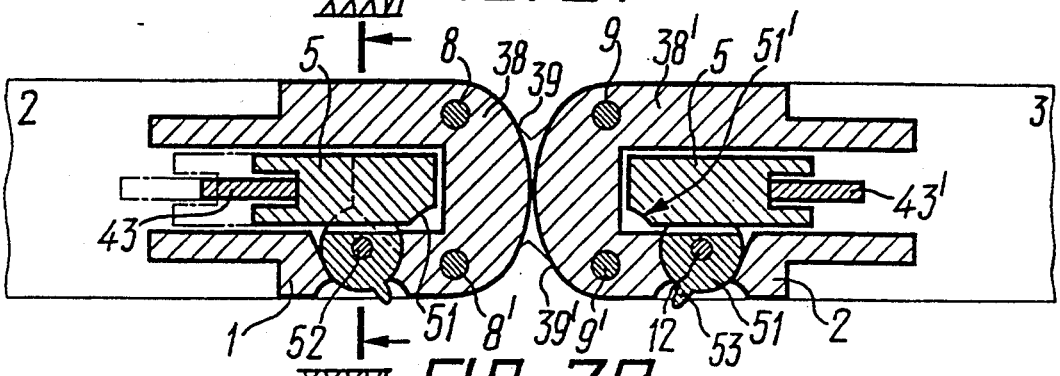
FIG. 32 is a sectional view on the line XXXII—XXXII in FIG. 30.
Figure 33:
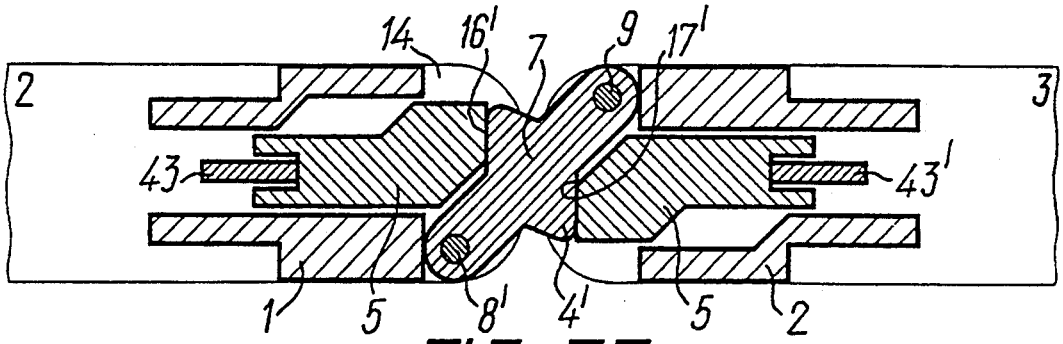
FIG. 33 is a sectional view on the line XXXIII—XXXIII in FIG. 30.
Figure 34:
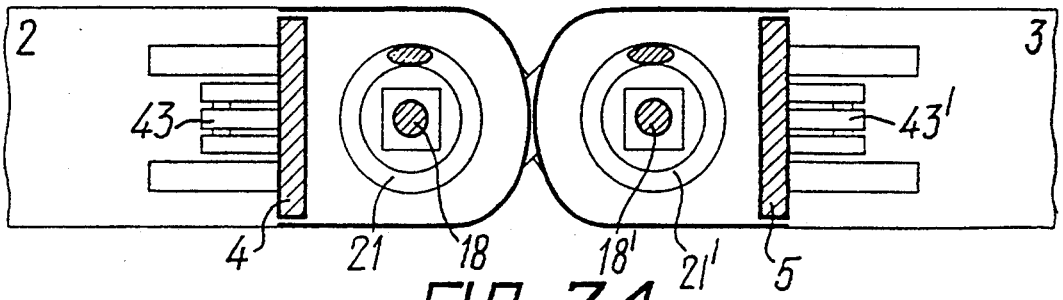
FIG. 34 is a sectional view on the line XXXIV—XXXIV in FIG. 30.
Figure 35:
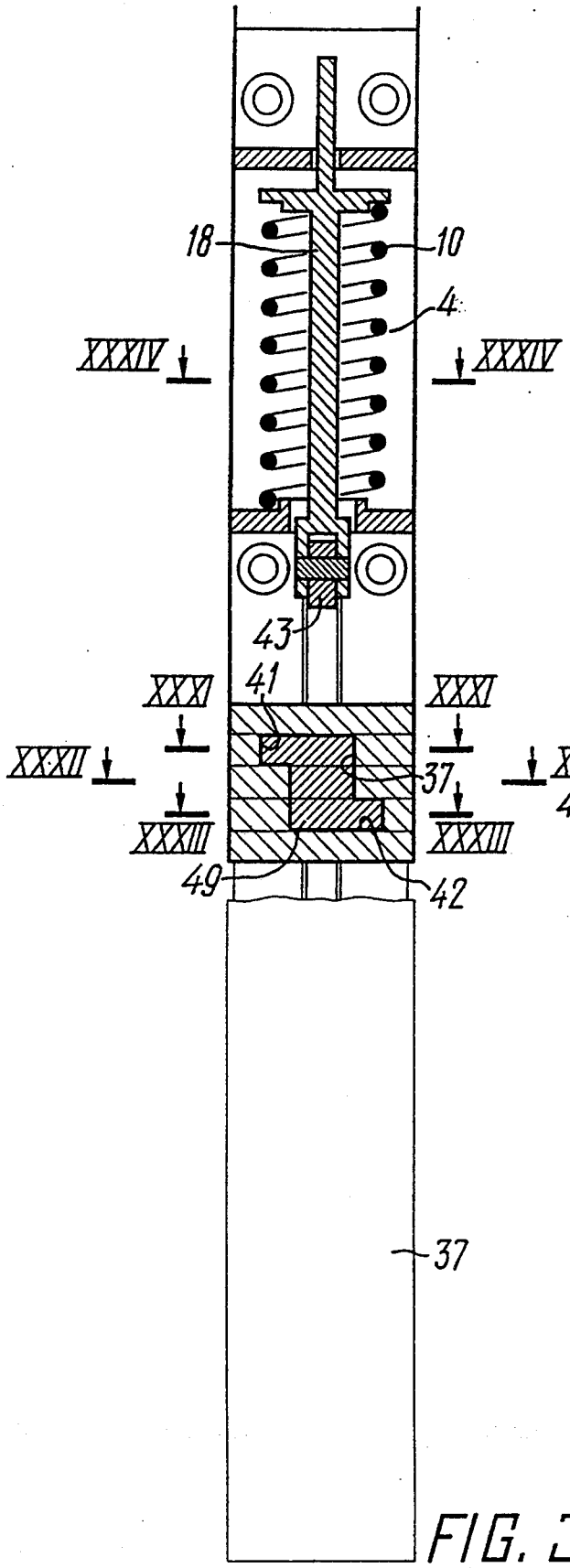
FIG. 35 is a sectional view on the line XXXV—XXXV in FIG. 30.
Figure 36:
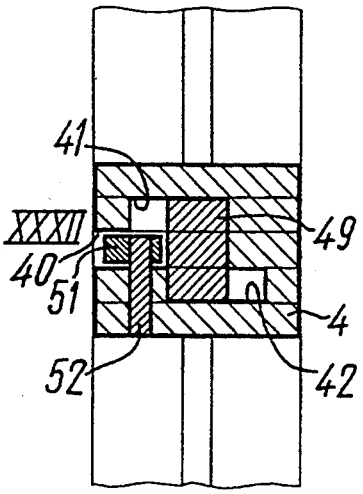
FIG. 36 is a sectional view on the line XXXVI—XXXVI in FIG. 32.

In the initial position the suspension members 2, 3 (FIGS. 30 to 34 ) are disposed coaxially so that their end surfaces, which face each other, are joined. This corresponds to the position, for instance, of closed doors. In this position the double-arm levers 43, 44, 43', 44' exert pressure to the pressing element 49, 49' under the force of springs. The eccentric cam 51, 51' does not retard the longitudinal movement of the pressing element 49, 49' (FIGS. 31,32 and 36). In this position the double arm levers 43, 44, 43', 44' and the rods 18 can move with the movement of the pressing element 49, 49'. In case of a turn of one of the suspension members 3 relative to the other suspension member 2 (not shown), the springs 21 get compressed dune to the motion of the pressing element 49, 49' in the slot 37, 37', due to a turn of the double-arm levers 43, 44, effected by the rest surfaces 16, 17 and 16', 17' of the levers 6, 7 being turned, due to the movement of the rods 18, the flanges 19 of which act on the springs 21. Thereupon the suspension members 2, 3 take positions parallel to each other. In case the held suspension member is released in this position, for instance, the suspension member 3, the springs 21 come loose, exerting pressure to the rods 18 via the flanges 19. The rods act upon the end plane of the pressing element 49, 49' by means of the double-arm levers 43, 44, 43', 44'. Whereafter the opposite end of the pressing element 49, 49' acts on the rest surfaces 16, 17 and 16',17' of the levers 6 and 7 (FIGS. 30 to 33). Owing to this action, the levers 6, 7 turn into the opposite direction, which results in a turn of the suspension members 2 and 3 relative to each other and the suspension members return to the initial position.

In case it is required to abandon the self-return to the initial position of the suspension members 2 and 3, a quarter turn of the closing accentric cam 51, 51' is effected to the position with the suspension members 2 and 3 being parallel to each other (in the door open position, for instance) and the springs 21 compressed. As a result, the steps formed by the recesses 50, 50' of the pressing elements 49, 49' bear against the closing accentric cams 51,51' and do not press the levers 6 and 7. With a turn of the suspension members 2 and 3, carried out by force, the pressing elements 49, 49' and the double-arm levers 43 43, 44, 43', 44' do not move, the rods 18 remain motionless and have no influence on the hinge operation. This being the case, the self-return to the initial position of the suspension member does not take place and the operation of the hinge remains similar in everything to the operation of the design variants described above with references to FIGS. 1 to 12.

Everyting said above with references to FIGS. 15 to 21 concerning a change in the effort of springs and displacement of the rods with the suspension members being open and closed, holds good for the given variant of the design. The difference lies in the employment of the double-arm levers 43, 44, 43', 44', which makes it possible to reduce the rigidity of springs and to increase the effort required to open the suspension members. Thereto, the said variant of the design ensures a simpler and more reliable method of attaching the hinges to suspension members and an access to the mechanism of self-return to the initial position of the suspension members in case of repairs or servicing.

Figures 25, 26, 27, 28, 29:
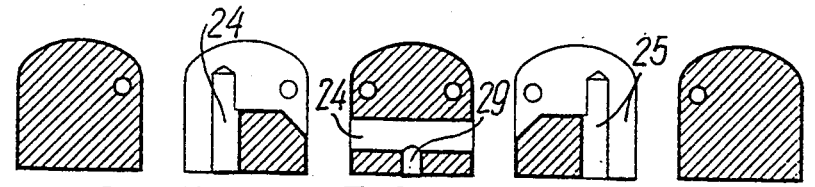
FIG. 25 is a sectional view on the line XXV—XXV in FIG. 24.
FIG. 26 is a sectional view on the line XXVI—XXVI in FIG. 24.
FIG. 27 is a sectional view on the line XXVII—XXVII in FIG. 24.
FIG. 28 is a sectional view on the line XXVIII—XXVIII in FIG. 24.
FIG. 29 is a sectional view on the line XIX—XIX in FIG. 24.
Figure 30:
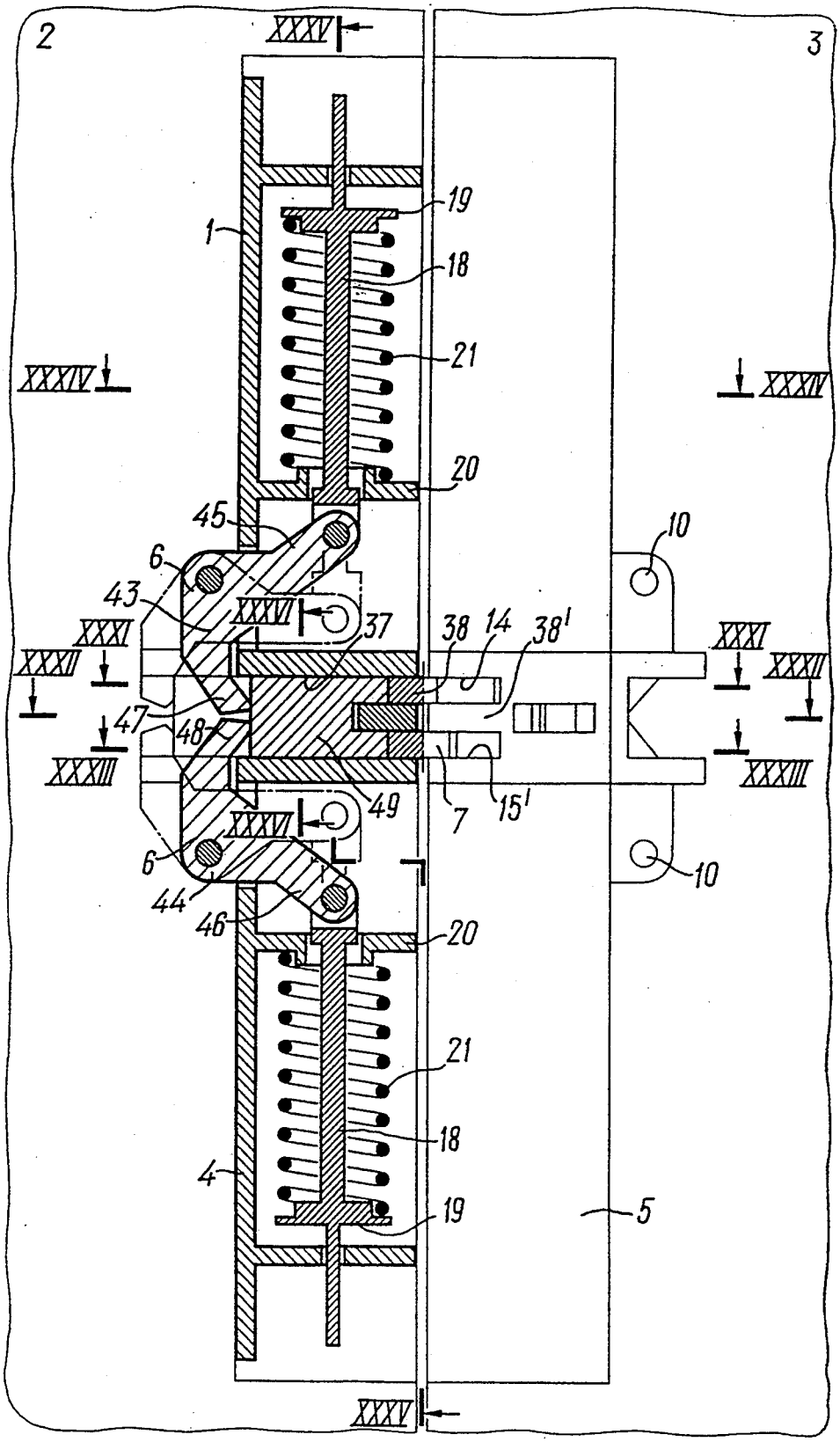
FIG. 30 illustrates another variant of the hinge design, persuant to the invention, for the front view with a partial section of the suspension member self-return mechanism to the initial position.

As FIG. 25 shows, the hinge is provided with a cover 54 to protect the mechanism against dust and foreign objects. Such a cover can be used for all variants of the hinge design furnished with the self-return mechanism.

INDUSTRIAL APPLICABILITY

In accordance with the invention the hinge can be most successfully employed for joining door wings when required to ensure their full turn to both sides through 180° or relatively to each other through 360° to allow a passage through the door opening, for instance, of an intensive stream of people or animals.

We claim:

1. A hinge for first and second suspension members (2,3) comprising:

a first joining component (4) attachable to a first suspension member (2), said first joining component (4) having a first rotation axle (8) and a second rotation axle (8'), and a second joining component (5) attachable to a second suspension member (3), said second joining component (5) having a first rotation axle (9) and a second rotation axle (9');

first and second levers (7,6) connecting said joining components (4,5) to each other, said first lever (7) having a first end rotatably mounted on said first axle (8) of said first joining component (4) and a second end rotatably mounted on said second axle (9') of said second joining component (5), said second lever (6) having a first end rotatably mounted on said first axle (9) of said second joining component (5) and a second end rotatably mounted on said second axle (8') of said first joining component (4), said levers (6,7) being disposed in different, parallel planes and having opposite angles of inclination to define an intersection point (0) of longitudinal axes (F1F4 and F2F3) passing through the respective levers, said levers being pivotably movable concurrently in said parallel planes around said axles (8,9' and 8',9) between open and closed positions of the suspension members of the hinge, said levers (6,7) being of equal length between said axles (8,9' and 8' 9), and a locus of points formed, upon turning of the joining components (4,5) relative to each other, by said intersection point (0) of longitudinal axes (F1F4 and F2F3) of the levers (6,7) in a plane parallel to the plane of lever movement, being an elliptical curve, whereby low bending deformations of said hinge, its rigidity and essentially gap-free mutual coupling of said joining components (4,5) and said suspension members (2,3) in any position of said hinge between said open and closed positions are achieved, said joining components (4,5) having end surfaces (11,12) facing one another which in the open position of the hinge are in adjoining relation with substantially no gap therebetween, said end surfaces being of convex, curvature having generating lines extending parallel to axes of rotation of said rotation axles, said convex, curvature of said end surfaces being of semi-elliptical shape corresponding to the elliptical curvature of said locus of points formed by said intersection point (0) of the longitudinal axes of said levers, upon turning of said components, and enabling said components to turn to said open position substantially through an angle of 360° while maintaining substantially no gap between said end surfaces (11, 12) of said joining components (4, 5).

2. The hinge according to claim 1, wherein intersection points (F1, F2 and F3, F4) of the lever (6 and 7) rotation axles (8,9' and 8',9) with a plane parallel to the plane of lever (6 and 7) movement are located at vertexes of a quadrangle, with the joining components (4, 5) being disposed coaxially in said closed position.

3. The hinge according to claim 1, wherein intersection points (F1, F2 and F3, F4) of the geometrical axes of the lever (6 and 7) rotation axles (8,9' and 8',9) with a plane parallel to the plane of the lever (6, 7) movement are located at vertexes of a quadrangle with the joining components (4,5) being disposed parallel to one another in said open position.

4. The hinge according to claim 1, wherein a spacing (F1–F4, F2–F3) between intersection points (F1, F2 and F3, F4) of geometrical axes of the respective lever (6 and 7) rotation axles (8, 9' and 8', 9) with a plane parallel to the plane of lever (6 and 7) movement is at least equal to a maximum dimension (B) of one of said components in a plane passing through the geometrical axes of the rotation axles (8, 9' and 8'), located in said one joining component.

5. The hinge according to claim 1, wherein each joining component (4, 5) is provided with two slots (14, 15 and 14', 15') accommodating the levers (6, 7), each of which is furnished with rest surfaces (16, 17 and 16', 17') in opposition and with a pair of spring-loaded rods (18) having a freedom to move and ends interacting with said rest surfaces (16, 17 and 16', 17') of the levers (6, 7).

6. The hinge according to claim 5, wherein said rods (18) are furnished with flanges (19) and the joining components (4, 5) with rests (20, 20') and between the rests (20, 20') of the joining components (4, 5) and the flanges (19) of the rods (18) there are mounted springs (21, 21').

7. The hinge according to claim 6, wherein each joining component (4, 5) includes a stop mechanism for the respective spring-loaded rod (18).

8. The hinge according to claim 7, wherein each joining component (4, 5) has a separation web (23), disposed between the slots (14, 15 and 14', 15') to accommodate the levers (6 and 7) and having a hole (24, 24'), the axis (0—0') of which is located in a symmetry plane of the slots (14, 15 and 14', 15'), said joining components (4, 5) having guiding holes (25, 26 and 25', 26') crossing the hole (24, 24') in the separation web (23) of the joining component (4, 5) serving as guides for the movements of the spring-loaded rods (18), said stop mechanism including a stopping element (28, 28'), mounted with freedom to rotate in the hole (24, 24') of the separation web (23) of the joining component (4, 5), and having diametrically opposite grooves (29, 29'), spaced along the joining component to receive the rods (18), said rods having ends with flats (27) disposed in the guiding holes (25, 26 and 25', 26'), the flats (27) having widths smaller than that of the grooves (29, 29') of the stopping elements (28, 28').

9. The hinge according to claim 8, wherein the spring-loaded rods (18) include pushers (18*a*), flexibly attached to free ends of the rods to interact with the rest surfaces (16, 17 and 16' 17') of the levers (6, 7).

10. The hinge according to claim 9, wherein the pushers (18*a*) are in the form of plates, whereas the rods (18) are of a cylindrical cross-section, said stopping element (28, 28') having a shape of a cylindrical stem, provided along its side surface with diametrically opposed and longitudinally spaced grooves (29, 29') of a semicircular cross-section, which receive the rods (18) the width of the pusher (18*a*) plates being smaller than the width of the grooves (29, 29') of the stopping elements (28, 28').

11. The hinge according to claim 9, wherein each joining component (4, 5) has a guiding slot (37, 37') in a plane parallel to the plane of the lever (6, 7) movement, whereas the slots (14, 15 and 14', 15'), accommodating the levers (6, 7), are formed by the separation web (38, 38'), disposed parallel to the levers (6, 7) and located in a part of the guiding slot 37, 37') from the side of the end surface (39, 39') of the joining component (4, 5), each joining component having a through slot (40, 40'), connected with the guiding slot (37, 37' and disposed parallel to the plane of the separation web (38, 38') with the levers (6, 7) disposed in the guiding slot (37, 37') on both sides of the said separation web (38, 38'), said guiding slot (37, 37') having in a cross-section in a plane normal to the planes of the lever (6, 7) movements two skew-symmetric recesses (41, 42, 41' 42'), whereas the pushers comprise a pair of double-arm levers (43, 44, 43' 44'), flexibly attached to each joining component, with one set of arms (45, 46, 45', 46') flexibly connected to the spring-loaded rods (18), mounted in the guiding holes of the joining component (4, 5) normal to the separation web (38, 38'), whereas the other set of arms (47, 48, 47', 48') bear against an end of the pressing element (49, 49'), arranged in the guiding slot (37, 37'), and a recess (50, 50'), that provides a step in a cross-section in a plane parallel to the plane of the separation web (38, 38') from the side opposite said end, said stop mechanism for the spring-loaded rod (18) including a closing eccentric cam (51, 51') interacting with said step, formed by the recess (50, 50') at the end of the pressing element (49, 49'), mounted on the rotation axis (52, 52') in the through slot (40, 40') and having a projecting control boss (53, 53').

12. The hinge according to claim 1, wherein said axles of said first and second joining components are respectively disposed at focal points of the end surfaces of said first and second end surfaces.

13. The hinge according to claim 1, wherein said semi-elliptical end surfaces have respective concavities therein which interengage in the closed position of the hinge.

14. The hinge according to claim 1, further comprising means including springs for returning the joining components to said closed position after said components have been moved to said open position and released.

* * * * *